US008986808B2

(12) United States Patent
George et al.

(10) Patent No.: US 8,986,808 B2
(45) Date of Patent: Mar. 24, 2015

(54) CHLOROPHYLL COOLING AGENT FOR SYNTHETIC TURF COMPONENTS

(76) Inventors: Milo George, McComb, OH (US); Randolph S. Reddick, Calhoun, GA (US)

( * ) Notice: Subject to any disclaimer, the term of this patent is extended or adjusted under 35 U.S.C. 154(b) by 857 days.

(21) Appl. No.: 13/197,306

(22) Filed: Aug. 3, 2011

(65) Prior Publication Data

US 2013/0034671 A1 Feb. 7, 2013

(51) Int. Cl.

| | |
|---|---|
| ***E01C 13/08*** | (2006.01) |
| ***D01F 1/10*** | (2006.01) |
| ***B32B 27/18*** | (2006.01) |
| ***D01F 1/06*** | (2006.01) |
| ***D01F 1/04*** | (2006.01) |
| ***D06M 15/263*** | (2006.01) |
| ***D01D 5/34*** | (2006.01) |
| ***D06P 1/34*** | (2006.01) |

(52) U.S. Cl.

CPC .. *D01F 1/06* (2013.01); *D01F 1/04* (2013.01); *E01C 13/08* (2013.01); *D06M 15/263* (2013.01); *D01D 5/34* (2013.01); *D01F 1/106* (2013.01); *D06P 1/34* (2013.01)

USPC ..... 428/96; 428/17; 428/95; 428/97; 264/173.18; 264/172.11; 264/172.15; 264/172.18; 427/427.4; 427/427.6

(58) Field of Classification Search

CPC ..... D01F 1/106; D01F 1/10; D01F 1/04; D01F 1/06; D01F 8/00; D01F 8/06; D01F 8/12; D01F 8/14; D01F 6/00; D01F 6/04; D01F 6/06; D01F 6/60; D01F 6/62; E01C 13/08; E01C 2013/08; D10B 2505/202; Y10S 273/13; B32B 2307/71; B32B 27/18; C08K 5/0041

USPC ..... 428/17, 97, 96, 95, 92, 87; 427/421.1, 427/427.4, 427.6; 264/172.15, 172.17, 264/172.18, 173.18

See application file for complete search history.

(56) References Cited

U.S. PATENT DOCUMENTS

| | | | | |
|---|---|---|---|---|
| 2,364,289 | A * | 12/1944 | Hale | 442/19 |
| 2,481,366 | A | 9/1949 | Thimann | |
| 3,731,923 | A | 5/1973 | Greene | |
| 5,645,933 | A * | 7/1997 | Sakazume et al. | 442/290 |
| 6,134,718 | A | 10/2000 | Sesselmann | |
| 6,454,848 | B2 | 9/2002 | Sliwinski et al. | |
| 6,524,981 | B1 | 2/2003 | Srinivasan | |

(Continued)

FOREIGN PATENT DOCUMENTS

| | | | |
|---|---|---|---|
| CN | 101979430 | A * | 2/2011 |
| CN | 102797322 | A * | 11/2012 |

(Continued)

OTHER PUBLICATIONS

Infrared Reflective Inorganiz Pigments Ashwini K. Bendiganavale & Vinod C. Malshe.

(Continued)

*Primary Examiner* — Cheryl Juska

(74) *Attorney, Agent, or Firm* — Southeast IP Group; Thomas L. Meses

(57) ABSTRACT

An artificial turf is disclosed having a base and a plurality of synthetic fibers attached to and extending upward from the base, the fibers comprising a chlorin-based organic colorant and the colorant reflects infrared radiation in the range of 700 to 1,100 nm.

25 Claims, 2 Drawing Sheets

(56) References Cited

U.S. PATENT DOCUMENTS

| | | | | |
|---|---|---|---|---|
| 6,589,297 | B2 | 7/2003 | Mach et al. | |
| 7,008,604 | B2 * | 3/2006 | Smalley et al. | 423/447.1 |
| 7,148,161 | B2 | 12/2006 | Hellwig et al. | |
| 7,244,684 | B2 | 7/2007 | Hexels | |
| 7,414,089 | B2 | 8/2008 | Cheirrett et al. | |
| 2001/0004780 | A1 * | 6/2001 | Mach et al. | 8/478 |
| 2001/0022151 | A1 * | 9/2001 | Sliwinski et al. | 106/453 |
| 2003/0056432 | A1 * | 3/2003 | Prevost | 47/1.01 F |
| 2003/0138653 | A1 | 7/2003 | Rieblinger et al. | |
| 2006/0010620 | A1 * | 1/2006 | Krabbe et al. | 8/638 |
| 2007/0154661 | A1 | 7/2007 | Stroppiana | |
| 2011/0086228 | A1 | 4/2011 | Oien et al. | |
| 2011/0117297 | A1 * | 5/2011 | Harmeling | 428/17 |
| 2013/0177718 | A1 * | 7/2013 | Packer et al. | 428/17 |

FOREIGN PATENT DOCUMENTS

| | | | | |
|---|---|---|---|---|
| FR | 1.468.622 | | | 2/1967 |
| JP | 03113080 | A | * | 5/1991 |
| JP | 07247510 | A | * | 9/1995 |
| JP | 09048925 | A | * | 2/1997 |
| JP | 2006124984 | A | * | 5/2006 |
| JP | 2007154623 | A | * | 6/2007 |
| JP | 4091970 | B1 | * | 5/2008 |
| JP | 2009068271 | A | * | 4/2009 |
| KR | 20080102067 | A | * | 11/2008 |
| WO | WO 2009037309 | A1 | * | 3/2009 |

OTHER PUBLICATIONS

Synthetic Surface Heat Studies C. Frank Williams & Gilbert E. Pulley.

* cited by examiner

CHLOROPHYLL COOLING AGENT FOR SYNTHETIC TURF COMPONENTS

BACKGROUND OF THE INVENTION

The invention relates to improvements in synthetic turf for sports fields and the like, and particularly to synthetic turf which remains cooler under the sunlight.

It is believed that the present invention will materially enhance the quality of the environment of mankind by contributing to the maintenance of the basic life-sustaining natural elements. In particular, the present invention employs environmentally benign colorants, such as chlorophyll, in place of pigments, which may incorporate heavy metals. Artificial turf containing the benign colorants may be disposed of without contaminating the soil, and temporary coatings containing the benign colorants can be rinsed off without contaminating water.

The first synthetic turf was called Astroturf made with nylon fiber and was used in the mid 1960s to the early 1990s for most playing field applications, i.e., football, baseball, soccer, etc. The nylon fibers were very abrasive, which led to the development of polyolefin fibers, primarily polyethylene and polypropylene. Polyolefin fibers exhibit significantly lower abrasive characteristics, thus minimizing skin burns. Many improvements in the looks and durability have been made to artificial turf, but a significant drawback remains, namely the propensity of artificial turf to absorb infrared solar radiation and retain heat.

Studies have shown that artificial turf can reach temperatures that are 80° F. or greater than natural turf, under similar conditions. The surface of artificial turf has been measured to reach temperatures as high as 157° F. This elevated temperature of artificial turf can be unpleasant for sports participants, and even, at times, unsafe.

Disposing of artificial turf after its life has become a challenge due to its chemical make-up, and is considered hazardous in some geographic locations. The use of inorganic colorants, especially colorants containing heavy metals, exacerbates disposal of artificial turf.

The use of polyolefins in general, and polyethylene and polypropylene in particular, to manufacture synthetic turf is disclosed in Published Application US2007/0154661 A1 and U.S. Pat. No. 3,731,923. The use of pigments, in general, to provide a desired shade of color to the turf, is also known.

Chlorophyll and its derivatives have been used in various applications. U.S. Pat. No. 5,645,933 discloses copper chlorophyll and sodium iron chlorophyll as examples of pigment for use in polypropylene fabric used as tarps, house wraps, etc. U.S. Pat. No. 6,134,718 discloses impregnating garment fabric with chlorophyll to absorb odors. U.S. published application 2003/0138653 discloses using transparent or semi-transparent film for food packaging containing chlorophyll or chlorophyllin.

Conventional green pigments do not resemble chlorophyll in the infrared region, that is, they absorb infrared light, whereas chlorophyll reflects it. In camouflaging military equipment and installations, however, it has been found that chromium oxide pigments reflect infrared radiation similar to chlorophyll, so that the camouflage appears as natural foliage. The chromium oxide pigments may be incorporated in polyurethane, silicone elastomer and/or polyvinylidene coatings and fibers used in camouflage, as disclosed in U.S. Pat. Nos. 6,454,848; 6,589,297; 7,148,161; and 7,244,684.

A strong need remains for an artificial turf that stays relatively cool when exposed to solar radiation. Furthermore, any modifications to improve the heating characteristics of artificial turf should have a minimal adverse environmental impact, both from the viewpoint of day-to-day operations and with regard to disposal of the artificial turf, after its useful life.

SUMMARY OF THE INVENTION

The above objectives are accomplished according to the present invention by providing an artificial turf having a base and a plurality of synthetic fibers attached to the base and extending upward, wherein the fibers comprise a chlorin-based organic colorant and the colorant reflects infrared radiation in the range of 700 to 1,100 nm. Examples of useful colorants include chlorophyll and chlorophyll derivatives, in particular, chlorophyll (a), chlorophyll (b) and chlorophyllin. Green colorants are particularly advantageous, in that not only is heating of the artificial turf reduced, but the colorant enhances the appearance of the field.

The colorant may be distributed throughout the fiber, or concentrated on an outer surface of the fiber, such as by incorporating the colorant in the sheath of a sheath/core bicomponent fiber. In another embodiment of the invention, the fiber is provided with a coating containing the colorant and a suitable binder. The latter embodiment is particularly advantageous as a method of treating existing artificial carpet installations to improve their heating characteristics.

The present invention is believed to be useful with virtually any synthetic polymer used to manufacture the fibers of the artificial turf. In particular, the fiber may be a thermoplastic polymer, including polyolefin, polyester, and polyamide polymers.

Artificial turf may be "filled" with a layer of particulate filling overlaying the base and distributed between the fibers. The filling is selected to provide support for the fibers and/or to provide the artificial turf with the give and support of a natural grass surface. The colorant of the present invention may be incorporated into the filling particles or coated on to the surface of the particles along with a suitable binder. Alternatively, the artificial turf may be unfilled. Accordingly, the upper surface of the base may have the colorant incorporated therein or the base may be coated with the colorant and a suitable binder.

With regard to coating the colorant on the artificial turf, it has been found to be useful to employ an acrylic polymer binder, such as an acid-functionalized acrylic polymer that is water soluble in the presence of a cationic counter ion. In one embodiment both the colorant and the binder are water-soluble, which provides ease and uniformity of application. The water-soluble colorant may be chlorophyllin.

DETAILED DESCRIPTION OF A PREFERRED EMBODIMENT

Figure 1:
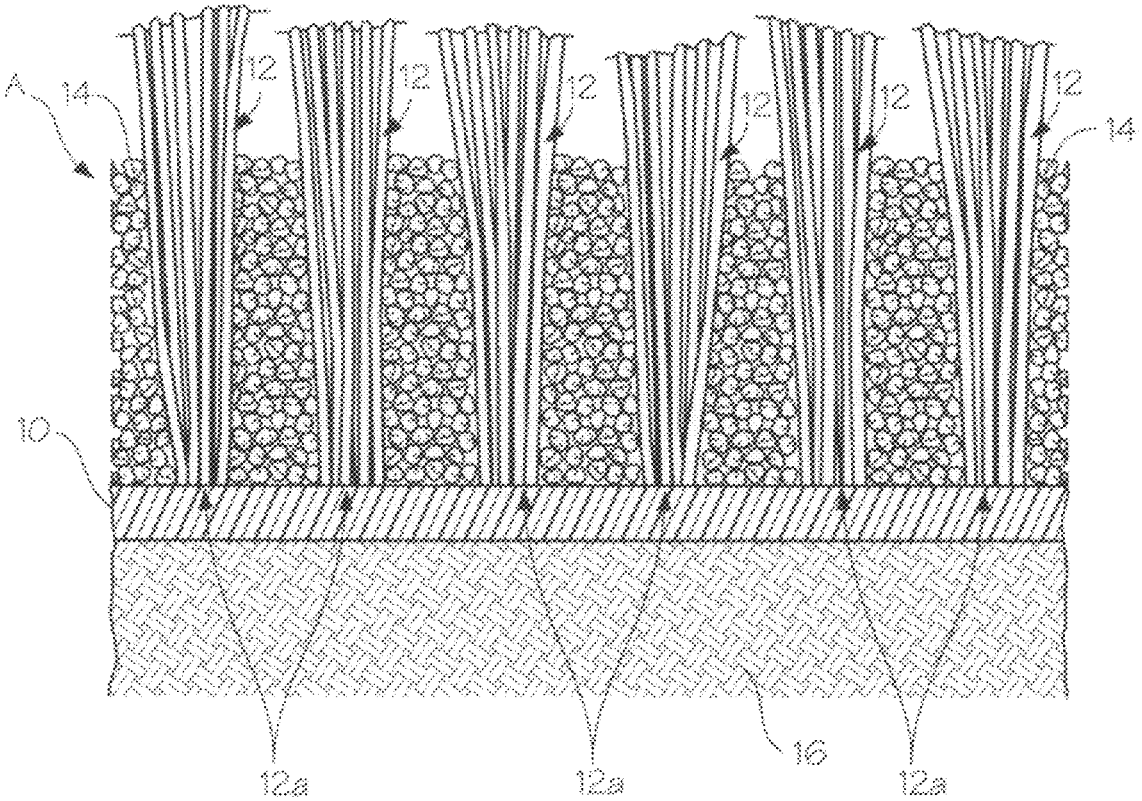
FIG. 1 illustrates a section of artificial turf according to the invention.

Without limiting the scope of the invention, the preferred embodiments and features are hereinafter set forth. All of the United States patents, published applications and unpublished pending applications, which are cited in the specification, are hereby incorporated by reference. Unless otherwise indicated, conditions are 25° C., 1 atmosphere of pressure and 50% relative humidity, concentrations are by weight, and molecular weight is based on weight average molecular weight. The terms "polymer" or "polymeric" as used in the present application denotes a material having a weight average molecular weight (Mw) of at least 5,000. Such polymeric materials can be amorphous, crystalline, semi-crystalline or elastomeric polymeric materials.

Artificial turf is constructed with a base and a plurality of synthetic fibers attached to and extending upward from the base. By way of example, the base may be a polyurethane or rubber backing, and the fibers may be tufted into the backing. The fibers may be monofilaments or grouped together with other fibers to form a multifilament structure. Suitable synthetic fibers include thermoplastic polymer fibers, such as polyolefins, particularly, polyethylene, polypropylene, and copolymers of ethylene and propylene, polyesters, particularly polyethylene terephthalate and polyamides, particularly nylon. The invention is not intended to be limited to a particular type of polyethylene. By way of example, the polyethylene polymer may be high density polyethylene (HDPE). Also included are functionalized polyolefins, for example, polyolefins having a carboxylic acid or acid anhydride functionality to improve the adhesion of a coating applied to the fiber.

The artificial turf may be filled or unfilled. Filled turf has a particulate filling overlaying the base and distributed between the fibers. The filling may be an inorganic material, such as sand, an organic material, such as rubber, or a combination of organic and inorganic materials, such as acrylic polymer or rubber coated sand. The filling may be a recycled material, such as rubber obtained from recycled tires. Filling particles in various sizes, shapes and combinations may be employed, such as crumb, spheres, fibrils, grains, and chips, to provide a playing field with the desired give and support for a particular activity.

The colorant is a chlorin-based, organic colorant. Chlorin is a large heterocyclic ring structure consisting at the core of three pyrroles and one pyrroline coupled through methine linkages. Useful colorants have substantial reflectance properties in the heat-producing region of the solar spectrum, namely in the range of 700 to 1,100 nm.

Suitable colorants include chlorophyll, for example, chlorophyll (a) and chlorophyll (b) and chlorophyll derivatives, such as chlorophyllin. Useful chlorophyll derivatives are intended to include colorants in which the magnesium ion in the center of the chlorin ring has been substituted with sodium/copper ions, as well as compounds in which substituent groups on the chlorin structure are eliminated, modified or substituted to alter the solubility of the colorant. For example, hydrophobic or hydrophylic substituent groups may be provided to alter the solubility. The chlorophyll derivate may also be a poly(oxyalkylene) substituted compound. In another embodiment, the chlorophyll derivative may include reactive substituent groups, such as hydroxyl groups, that allow the chlorophyll derivative to be bonded to a polymer binder. The colorant may be in the form of a pigment or dye, particularly a water-soluble dye. If the colorant is employed as a pigment, it is believed that the particle size should be more than half the wavelength of the light to be reflected. Thus, for reflecting infrared light of 700-1100 nanometers wavelength, particle size should be at least 0.55 microns.

Typical commercial sources for chlorophyll include alfalfa, wheatgrass, and barley grass, even though most dark leafy vegetables would be a suitable source.

In an embodiment of the invention, the colorant is green, that is, appearing green to the human eye, arising from light reflected from the surface of the colorant primarily in the range of 490 to 560 nm.

The colorant may be incorporated into the fibers of the yarn by conventional methods, such as by melt compounding a thermoplastic polymer and the colorant, followed by extrusion into the shape of fiber. The colorant may be concentrated into a "masterbatch" of the polymer, and then diluted with uncolored polymer during melt compounding to bring about the desired infrared reflectance and shade. The colorant may be distributed throughout the entire fiber, or the colorant may be concentrated on the surface of the fiber, such as can be achieved by incorporating the colorant into the sheath layer of a sheath/core bi-component fiber.

The colorant may also be incorporated into the particulate filling material. For example, the filling material may be a polymer, such as natural or synthetic rubber, and the colorant is distributed throughout the particle.

By way of example, the concentration of the colorant in the fiber, layer of the fiber containing the colorant, or in the particulate filling is in the range of 0.1% to 10%.

In another embodiment of the invention the colorant and a film-forming binder are sprayed, or otherwise coated on the surface of the fiber and/or particulate filling, to provide an aesthetically colored, infrared light reflecting layer. For unfilled artificial turf, the coating may be applied to the upper surface of the base, in addition to the fibers. Coating the fiber and infill material or base has a number of advantages, including concentrating the colorant where its infrared reflective properties are most useful and being able to treat existing artificial turf installations.

The coating of the colorant and the film-forming binder may be permanent or temporary, and suitable binders may be selected to achieve the desired results. Generally the binder may be a resin characterized as a non-crystalline solid material or liquid of a relatively high molecular weight, which adheres the colorant to a substrate. The binder and/or colorant may be dissolved or dispersed in a suitable organic or aqueous solvent. There are a wide variety of suitable, commercially available binders. By way of example and not limitation, the following compounds and mixtures thereof may be incorporated into the coating formulation: rosin and modified rosins, such as calcium, magnesium and zinc metallic resinates, ester gum of rosin, maleic resins and esters, dimerized and polymerized rosins and rosin modified fumaric resins; shellac, asphalts, phenolic resins and rosin-modified phenolic resins; alkyd resins; polystyrene resins and copolymers thereof; terpene resins; alkylated urea formaldehyde resins; alkylated melamine formaldehyde resins; polyamide resins; polyimide resins; vinyl resins, such as polyvinyl acetate and polyvinyl alcohol; ketone resins; acrylic resins, such as polyacrylic acid and polymethacrylic acid; epoxide resins; polyurethane resins; cellulosic resins, such as nitro cellulose, ethyl cellulose, cellulose acetate butyrate and carboxymethyl cellulose.

With regard to temporary coatings of the colorant and binder, acrylic polymers in general, and acid-functionalized acrylic polymers that are water soluble in the presence of a cationic counter ion, in particular, may be employed. Suitable acrylic polymers may be found in U.S. Pat. No. 7,414,089 B2 and U.S. Pat. No. 7,418,990 B2. Also within the scope of the invention is to employ a combination of two or more acrylic polymers, whereby the mechanical properties of the coating can be tailored over a range of rigidity to resilience, as desired. Another example of a water-soluble, temporary binder is the polyvinylpyrrolidone/vinyl acetate copolymer disclosed in U.S. Pat. No. 6,077,898.

In one example, the colorant is water-soluble, such as chlorophyllin, and the binder is water-soluble, so the coating may be applied as an aqueous solution and allowed to dry, with a minimum release of volatile organic compounds.

By way of example, the coating composition may contain from 0.1 to 10 weight % of the infrared reflective colorant. The coating composition may contain additional ingredients, such as pigments or dyes to compliment or shift the shade of the infrared reflective colorant. Opacifiers, plasticizers and other additives, as are known to those familiar with paint and coatings, may be employed. For example, the additional ingredients may include riboflavin to impart a yellow shade to the mixture.

While nearly 40% of the sun's energy occurs in the visible light range (400-700 nm), more than 50% of the sun's energy is in the nonvisible infrared region (700-2500 nm). It is believed that the artificial turf of the present invention can be formulated to achieve a reflectance of solar radiation in the range of 700 to 1,100 nm of 35% or greater, 50% or greater or even 65% or greater. The reflectance is measured using American Society for Testing and Materials standard ASTM G-173-03, Terrestrial Reference Spectra for Photovoltaic Performance Evaluation, in effect as of the filing date of this application.

FIG. 1 illustrates a vertical section of artificial turf "A" comprising a base 10 to be laid over a ground 11, comprising, in the most typical condition of use, a foundation of packed earth on which the artificial turf is laid. Base 10 is typically a layer of synthetic polymer material, for example, non-woven rubber or polyurethane coated cloth. Base 10 may include a secondary backing layer, for example, a latex coating such as SBR latex, on the underside.

A plurality of artificial turf fibers 12 extend upwards from the base 10, usually disposed in clumps or tufts so as better to simulate blades of grass in natural turf. In the embodiment illustrated here, fibers 12 are anchored to the base 10 at lower ends 12*a*, and their distal ends 12*b* extend upward for a desired length from base 10. The general production technique of base 10 and fibers 12 are known, for example by tufting the fibers in the base, and thus do not require a detailed description here:

When the artificial turf is laid, a particle based infill material 14 is dispersed among the fibers 12, above the base 10, to act as a filler or infill material. The function of material 14 is substantially that of maintaining fibers 12 in an upright configuration, and to modify the resilience of the artificial turf. The particle based material 14 is dispersed among fibers 12 in sufficient quantities such that the yarns are supported by infill material 14. In a particularly advantageous embodiment, particle based material 14 and fibers 12 include the infrared reflective colorant of the present invention.

Figure 2:
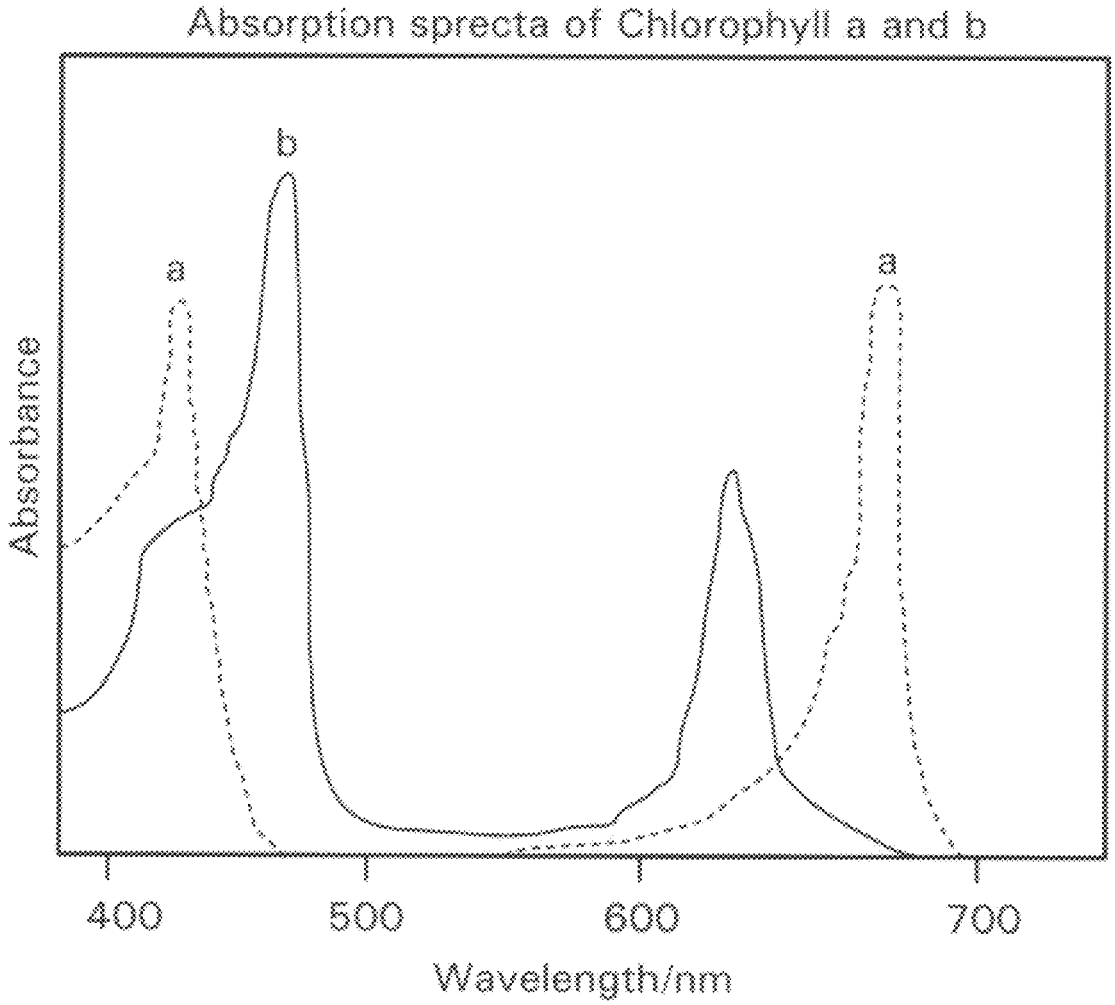
FIG. 2 is a graph showing the absorption spectra of chlorophyll (a) and chlorophyll (b) in the visible range.

Referring to FIG. 2, the absorption spectrum of chlorophyll (a) and chlorophyll (b) show that they absorb strongly in the red and blue-violet regions of the visible spectrum, and reflect in the green region.

An important advantage of the present invention is that the artificial turf remains relatively cool when exposed to intense sunlight. Accordingly, the artificial turf retains its flexibility and mechanical properties longer, and is less prone to surface deterioration, delaminating, warping, distortion and other types of degradation and failure that accumulated heat can cause.

While a preferred embodiment of the invention has been described using specific terms, such description is for illustrative purposes only, and it is to be understood that changes and variations may be made without departing from the spirit or scope of the following claims.

What we claim is:

1. An artificial turf having a base and a plurality of synthetic fibers attached to and extending upward from the base, the fibers comprising a chlorin-based organic colorant and a binder coated on the surface of the fibers, wherein the colorant reflects infrared radiation in the range of 700 to 1,100 nm, and wherein the artificial turf is unfilled and the colorant and binder are coated on an upper surface of the base.

2. The artificial turf of claim 1, wherein the fibers are comprised of a thermoplastic polymer.

3. The artificial turf of claim 1 wherein the fibers are selected from the group consisting of polyolefin, polyester and polyamide polymers.

4. The artificial turf of claim 1 wherein the fibers are selected from the group consisting of polyethylene, polypropylene, and copolymers of ethylene and propylene.

5. The artificial turf of claim 1 wherein the colorant is a green colorant.

6. The artificial turf of claim 5 wherein the colorant is selected from one of chlorophyll (a), chlorophyll (b) and chlorophyllin.

7. The artificial turf of claim 5 wherein said green colorant is selected from the group consisting of chlorophyll and chlorophyll derivatives.

8. The artificial turf of claim 1 wherein the colorant is distributed throughout the fibers.

9. The artificial turf of claim 1 wherein the colorant is concentrated on an outer surface of the fiber.

10. The artificial turf of claim 9 wherein the fibers are sheath-core, bi-component fibers, and the colorant is present in the sheath layer.

11. The artificial turf of claim 1 wherein said colorant is green and is selected from the group consisting of chlorophyll and chlorophyll derivatives.

12. The artificial turf of claim 11 wherein the binder is an acrylic polymer.

13. The artificial turf of claim 11 wherein the binder is an acid-functionalized acrylic polymer, which is water soluble in the presence of a cationic counter ion.

14. The artificial turf of claim 1 wherein the colorant is selected from one of chlorophyll (a), chlorophyll (b) and chlorophyllin.

15. The artificial turf of claim 1 wherein the colorant is water-soluble.

16. The artificial turf of claim 1 wherein the colorant is chlorophyllin.

17. The artificial turf of claim 16 wherein the binder is an acid-functionalized acrylic polymer, which is water soluble in the presence of a cationic counter ion.

18. A method of reducing heating in artificial turf having a base and a plurality of thermoplastic polymer fibers attached to and extending upward from the base, comprising the steps of providing a chlorin-based organic colorant on the surface of the fibers in sufficient quantity to reflect infrared radiation in the range of 700 to 1,100 nm, wherein the artificial turf is unfilled, and further comprising the step of coating the colorant and a binder on an upper surface of the base.

19. The method of claim 18 wherein the colorant is selected from the group consisting of chlorophyll (a), chlorophyll (b) and chlorophyllin.

20. The method of claim 18 wherein the fibers comprise the colorant and a binder coated on the surface of the fibers.

21. The method of claim 20 wherein the colorant is water-soluble, and the binder is an acid-functionalized acrylic polymer, which is water soluble in the presence of a cationic counter ion.

22. The method of claim 18 wherein the fibers are selected from the group consisting of polyethylene, polypropylene, and copolymers of ethylene and propylene.

23. The method for claim 19 wherein the colorant is green and enhances a color of the fibers.

24. The method of claim 19 wherein said colorant is provided on the surface of the fibers by melt compounding with a thermoplastic fiber followed by extrusion into the shape of a fiber.

25. The method of claim 19 wherein said colorant is provided on the surface of the fibers by using a bi-component fiber, and incorporating the colorant on an outer sheath layer of the bi-component fiber.

* * * * *